US010189639B2

(12) United States Patent
Bleich

(10) Patent No.: US 10,189,639 B2
(45) Date of Patent: Jan. 29, 2019

(54) TEA DISPLAY AND STORAGE DEVICE

(71) Applicant: Noah Bleich, Los Angeles, CA (US)

(72) Inventor: Noah Bleich, Los Angeles, CA (US)

( * ) Notice: Subject to any disclaimer, the term of this patent is extended or adjusted under 35 U.S.C. 154(b) by 126 days.

(21) Appl. No.: 15/207,208

(22) Filed: Jul. 11, 2016

(65) Prior Publication Data

US 2017/0008695 A1 Jan. 12, 2017

Related U.S. Application Data

(60) Provisional application No. 62/191,245, filed on Jul. 10, 2015.

(51) Int. Cl.
*B65D 85/808* (2006.01)
*B65D 81/26* (2006.01)
*B42F 5/00* (2006.01)

(52) U.S. Cl.
CPC ..... *B65D 85/8085* (2013.01); *B42F 5/005* (2013.01); *B65D 81/264* (2013.01)

(58) Field of Classification Search
CPC ... B65D 85/8085; B65D 81/264; B42F 5/005; G11B 33/0444
USPC ..... 206/472
See application file for complete search history.

(56) References Cited

U.S. PATENT DOCUMENTS 2,359,292 A 7/1942 Barnett
4,629,070 A * 12/1986 Roberg ..... B42F 7/02 206/232
D319,345 S * 8/1991 Rayburn ..... D3/251
5,323,553 A 6/1994 Candido
6,241,086 B1 * 6/2001 Bergh ..... B42F 7/025 206/232
6,267,234 B1 * 7/2001 Bergh ..... G11B 33/0422 206/308.1
6,672,452 B1 * 1/2004 Alves ..... G11B 33/0444 206/232
6,679,376 B2 * 1/2004 Chen ..... G11B 33/0433 206/308.1
6,994,215 B2 * 2/2006 Kim ..... G11B 33/0444 206/308.1
7,331,452 B2 * 2/2008 Bergh ..... B42F 7/025 206/308.1
2009/0188819 A1 * 7/2009 Carney, Jr. ..... A47B 43/003 206/315.1

FOREIGN PATENT DOCUMENTS

CN 2057913 U 6/1990
RU 54918 U1 7/2006
WO WO 1998001299 A1 1/1998

* cited by examiner

*Primary Examiner* — Chun Cheung
(74) *Attorney, Agent, or Firm* — Kunzler, PC

(57) ABSTRACT

A Tea Display and Storage Device includes a front and back cover, a centralized spine with pages bound to it, a plurality of tea bag holders on each page to carry individual tea bags and a fastener to keep the Tea Display and Storage Device closed when not in use. The covers and the tea bag holders contain an absorbent layer to keep the tea bags fresh. Each tea bag holder can either be open to allow easy removal of tea bags, or be closed to seal the tea bag against the page. The seal on the tea holder can be a tongue and grove system, magnets or a type of adhesive strip. To aid in identification of the tea bag in each holder, the teabag holder can be clear or if the holder is opaque, a name tag can be attached to the holder.

14 Claims, 9 Drawing Sheets

TEA DISPLAY AND STORAGE DEVICE

RELATED APPLICATION

The application claims the benefit of priority to U.S. Provisional Application Ser. No. 62/191,245 for a "Tea Storage and Display Device" filed Jul. 10, 2015, incorporated fully herein by this reference.

FIELD OF THE INVENTION

The present invention pertains generally to a device for use in the beverage or restaurant industry, or as a device for personal use by the general population. More specifically, the present invention pertains to a device that can hold tea bags. The present invention is particularly, but not exclusively, useful as a device to store and display tea bags for use.

BACKGROUND OF THE INVENTION

Tea is a beverage typically prepared by adding hot water to dried leaves, plants, fruits, and other herbs. The consumption of tea extends back centuries and after water, it is currently the most widely consumed drink in the world.

Tea can come in various packages and states. A consumer can purchase tea in loose leaf form or in individually wrapped packets. In many instances, tea is purchased in a cardboard box and the tea is in individual porous sealed bags that are not individually wrapped. Other times, the tea bags are individually wrapped in a paper envelope. These tea bags allow the tea leaves to be steeped in hot water, while making the disposal of the tea leaves easy for consumers.

At restaurants, coffee shops, cafes, and other places of social gathering, tea is often served. Because the types and flavor often vary, few places offer a complete list of teas available and it is cumbersome to bring a sample of every tea bag to the consumer's table when a list is unavailable and there are numerous tea options. In addition to being bulky, having to assemble the various tea options every time a customer orders tea is time consuming and inefficient. Furthermore, in many cases, bringing the consumer a variety of loose tea bags will lead to waste when unused tea bags are discarded.

In light of the above, it would be advantageous to provide a device that will allow the display and storage of individual tea bags in a timesaving, compact, and portable manner that is effective in minimizing waste, while still allowing the consumer to choose from a variety of tea options.

SUMMARY OF THE INVENTION

The Tea Display and Storage Device of the present invention is capable of compactly storing and displaying tea for consumption. The Tea Display and Storage Device of the present invention allows consumers to effectively and easily choose from a variety of tea bags, without causing unnecessary waste.

A preferred embodiment of the Tea Display and Storage Device of the present invention consists of a cover with a number of pages. Each page consists of a plurality of tea bag holders that allow a variety of tea bags to be simultaneously visible and selected by a customer. The tea bag holders are formed by sheets of material with seams creating pockets. The user can place tea bags into tea bag holders for storage and display. Different arrangements or configurations and varying sizes and shapes of tea bag holders may be used. In a preferred embodiment, the cover of the Tea Display and Storage Device is designed to resemble a book with a snap or other fastener in order to keep the Tea Display and Storage Device in a closed configuration.

In an alternative embodiment, each of the tea bag holders completely envelopes the tea bag and in another embodiment, the name of the tea is printed on the outside of the tea bag holder in order to easily ascertain the brand, flavor, or type of the tea.

In another alternative embodiment of the Tea Display and Storage Device of the present invention, the tea bag holder has a lateral tongue and groove sealing mechanism to keep water out of the tea bag holder and to seal in freshness of the tea bags.

In another alternative embodiment, each tea bag tea bag holder is lined in order to reduce the moisture inside the tea bag holder and preserve the quality of the tea.

In another alternative embodiment, the tea bag holder of the Tea Display and Storage Device of the present invention is formed with a cut out, which allows the user to easily slip the tea bag out of the tea bag holder using a single finger.

In another alternative embodiment of the Tea Display and Storage Device of the present invention, the inside of the cover is lined with a moisture absorbent layer to reduce moisture inside the Tea Display and Storage Device.

In another alternative embodiment of the Tea Display and Storage Device of the present invention, the internal pages of the device are help in place by a fastening clip making the pages removable, and the pages may be pre-loaded with tea bags for insertion as needed.

In yet another alternative embodiment of the Tea Display and Storage Device of the present invention, the teabag holders have a lateral opening, which allows the user to slip the tea bag in and out of the left or right side of the teabag holder. Also, while the Tea Display and Storage Device of the present invention is well suited for tea, it may also be used for other food products.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF A PREFERRED EMBODIMENT

Figure 1:
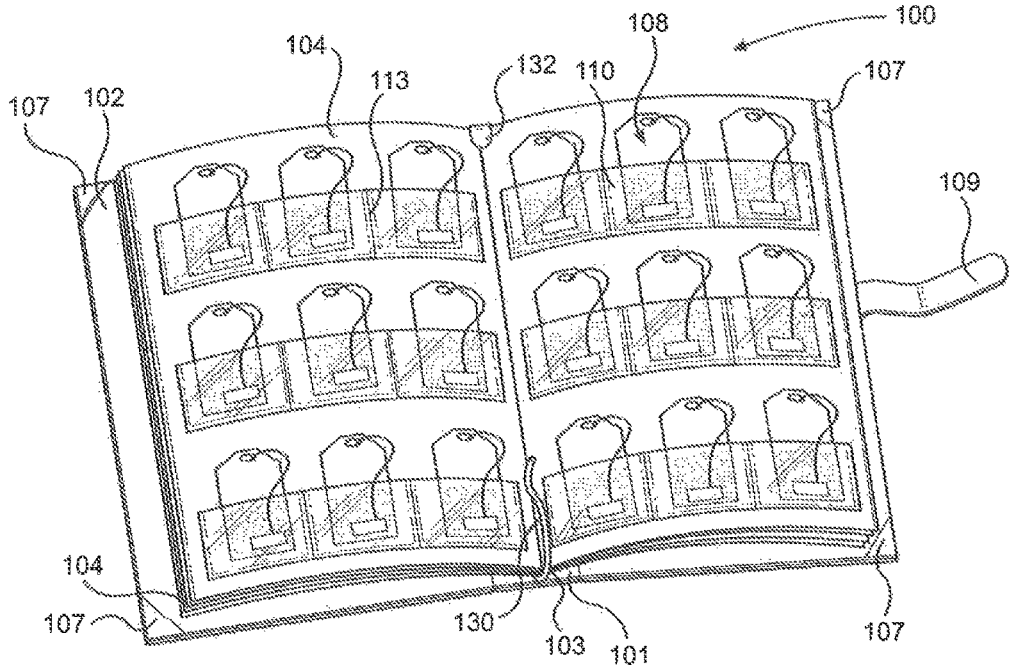
FIG. 1 is a perspective view of the Tea Display and Storage Device of the present invention in an open configuration, showing the cover, pages, snap fastener, rounded embossed edges, and tea bag holders with tea bags inside.

The present invention is a Tea Display and Storage Device capable of displaying and storing tea. Referring initially to FIG. 1, a preferred embodiment of the Tea Display and Storage Device of the present invention is shown and generally designated 100. As depicted in FIG. 1, the Tea Display and Storage Device 100 is depicted as a book.

The Tea Display and Storage Device 100 of the present invention comprises of a cover 102 with pages 104. Pages 104 can be made of various materials including, but not limited to, plastic, cardboard, paper, etc, and can have many different colors and designs. Pages 104 have individual tea bag holders 110. The tea bag holders 110 are formed by sheets of material with seams 113 creating pockets. The material is attached to pages 104 at seams 113 using any means known by those skilled in the art including, but not limited to, adhesives or sewing the material to the page 104. After a tea bag holder 110 is formed, the user can place tea bags 108 into tea bag holders 110 for storage and display. Three (3) rows of three (3) substantially rectangular tea bag holders 110 are shown in FIG. 1. However, different arrangements or configurations of tea bag holders 110 and varying sizes and shapes of tea bag holders 110 may be used. In addition, there may be varying amounts of tea bag holders 110 on each page 104.

Figure 2:
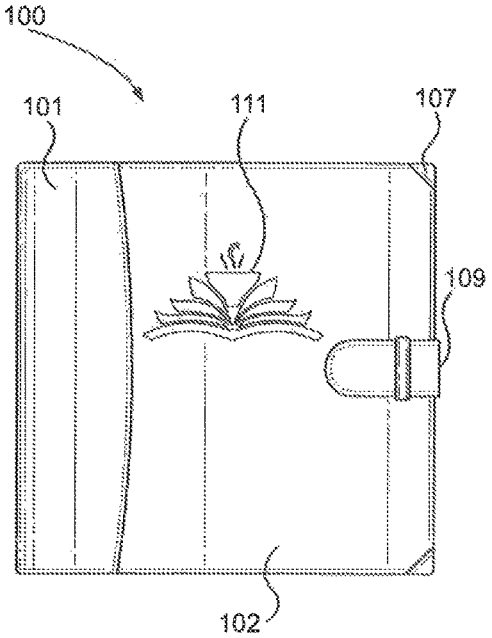
FIG. 2 is a front view of the Tea Display and Storage Device of the present invention in a closed configuration, showing the cover, snap fastener, and rounded embossed edges.
Figure 3:
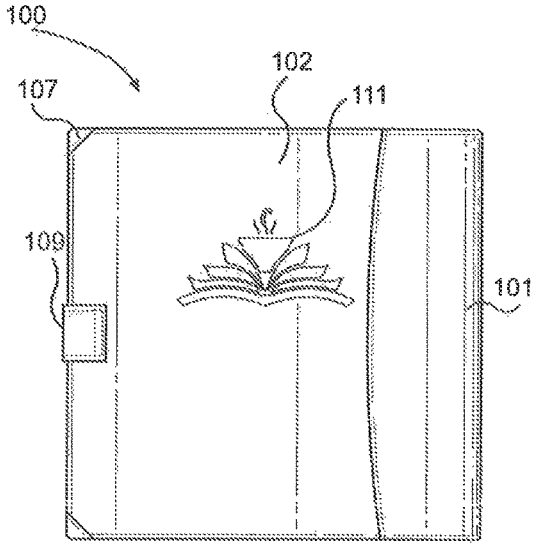
FIG. 3 is a back view of the Tea Display and Storage Device of the present invention in a closed configuration, showing the cover, snap fastener, and rounded embossed edges.

As shown in FIG. 1, the cover 102 of the Tea Display and Storage Device 100 of the present invention is shown having embossed edges 107, although the edges and style of the cover 102 may vary depending on the personal aesthetics of the user. In addition, the cover 102 can be varying sizes and shapes depending on the purpose and use of the user. In addition, the cover can be made of various materials including, but not limited to, wood, plastic, leather, cardboard, etc. The cover may be designed to resemble a book, or can have other emblems or designs adorning the cover. FIG. 1-3 of the Tea Display and Storage Device 100 of the present invention shows the cover resembling a book with a snap fastener 109 and spine 101. The Tea Display and Storage Device 100 of the present invention may also be a ring binder, with the cover 102 being a folder.

Pages 104 of the Tea Display and Storage Device 100 of the present invention are bound together to form binding 103 of pages 104, much in the same way that pages in a book are bound. While the means of attaching pages 104 together are shown in FIG. 1 as binding 103 them together, as stated above, the pages can be formed together using other means such as the ring binder. In that instance, the pages 104 of the Tea Display and Storage Device 100 of the present invention have holes in the pages 104 corresponding to the rings in the binder.

Pages 104 may be removably attached to the spine 101 with lower spring clip 130 and upper tab 132. In use, pages 104 may be prefilled with tea bags 108 and inserted into between spring clip 130 and spine 101, with the upper edge of the page 104 being placed under upper tab 132 to retain the page 104 in place.

FIGS. 2 and 3 are front and back views of the Tea Display and Storage Device of the present invention in a closed configuration. The cover 102 resembles a book with design 111 (or logo, or other identifying insignia), embossed edges 107, and spine 101. The snap fastener 109 is also shown in the closed configuration. The snap fastener 109 consists of a pair of interlocking discs that snap together to secure whatever material they are embedded in together. Here, one half of the snap fastener 109 would be located on one side of cover 102 and the other would be attached to a piece of material, which in turn is attached to the second side of cover 102. Thus, to open the Tea Display and Storage Device 100 of the present invention, the user has to pull the two interlocking discs from one another. While shown in FIGS.

1-3 as having a snap fastener 109 as a means of keeping cover 102 in a closed configuration, any method known by those skilled in the art may be used including, but not limited to, zippers, string, ribbon, toggles, magnets, etc. or there may not be any mechanism for closing the Tea Display and Storage Device 100 of the present invention.

Figure 4:
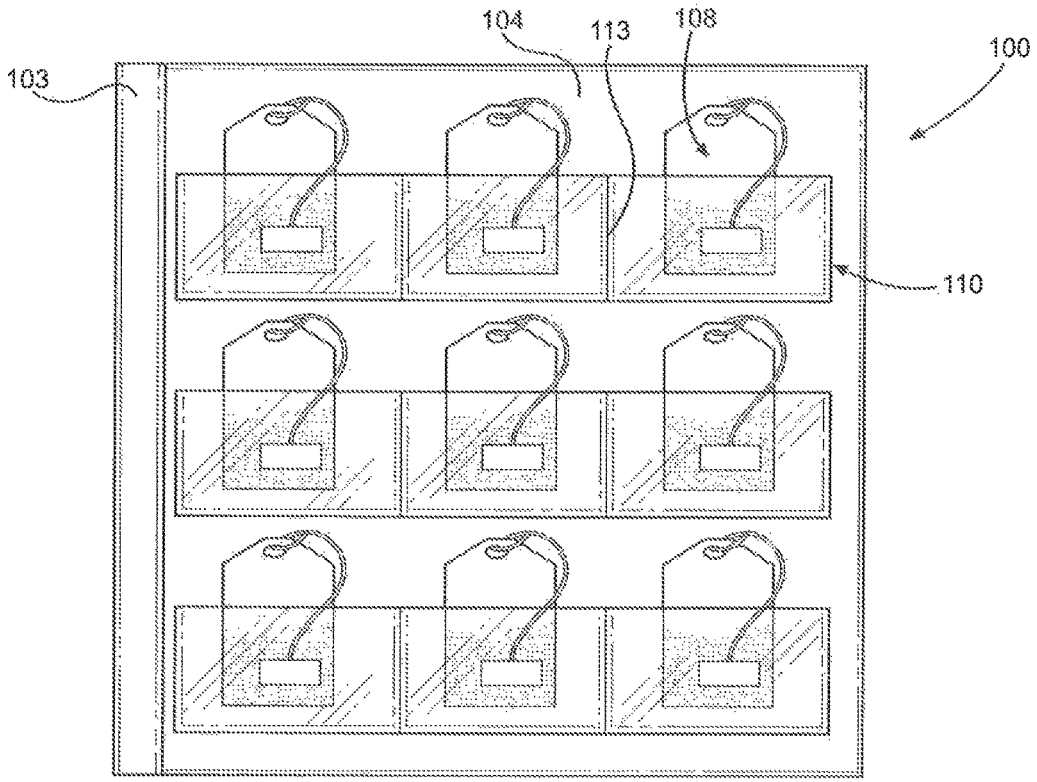
FIG. 4 is a front view of a page from the Tea Display and Storage Device of the present invention, showing three (3) rows of three (3) tea bag holders with tea bags inside.

Referring now to FIG. 4, a front view of an individual page 104 of the Tea Display and Storage Device 100 of the present invention is shown. The binding 103 is shown on the left side of the page where the pages 104 are attached to one another. As stated above, there can be varying amounts of tea bag holders 110 and can be made of various materials. When a user places the tea bag 108 in a tea bag holder 110, the tea bag 108 is not fully enveloped by tea bag holder 110.

Figure 5:
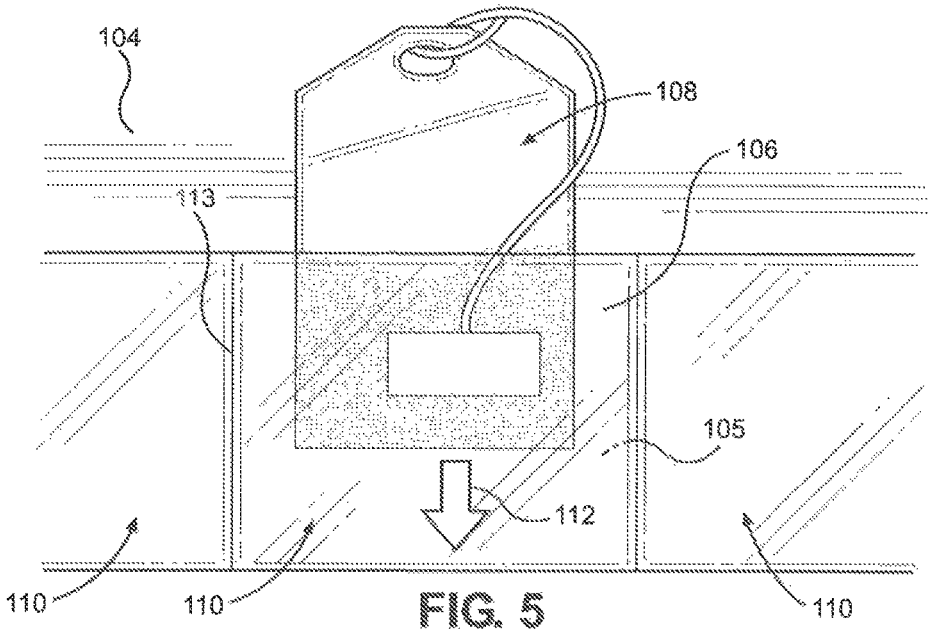
FIG. 5 is a detailed view of one (1) tea bag holder of the Tea Display and Storage Device of the present invention, showing the tea bag being inserted into the tea bag holder.

In FIG. 5, a detailed view of one (1) of the holders 110 is shown. To use the Tea Display and Storage Device 100 of the present invention, the user will slide the tea bag 108 into the tea bag holder 110 in the direction of arrow 112. As shown in FIG. 5 the holders have an inside surface 105 (shown in dashed lines) and an outside surface 106.

To use, the Tea Display and Storage Device 100 of the present invention is filled by placing a tea bag 108 in each of the tea bag holders 110. The cover 102 (Shown in FIG. 1) is then closed and may be opened whenever the user wishes to pick a particular tea bag 108 for consumption.

Figure 6:
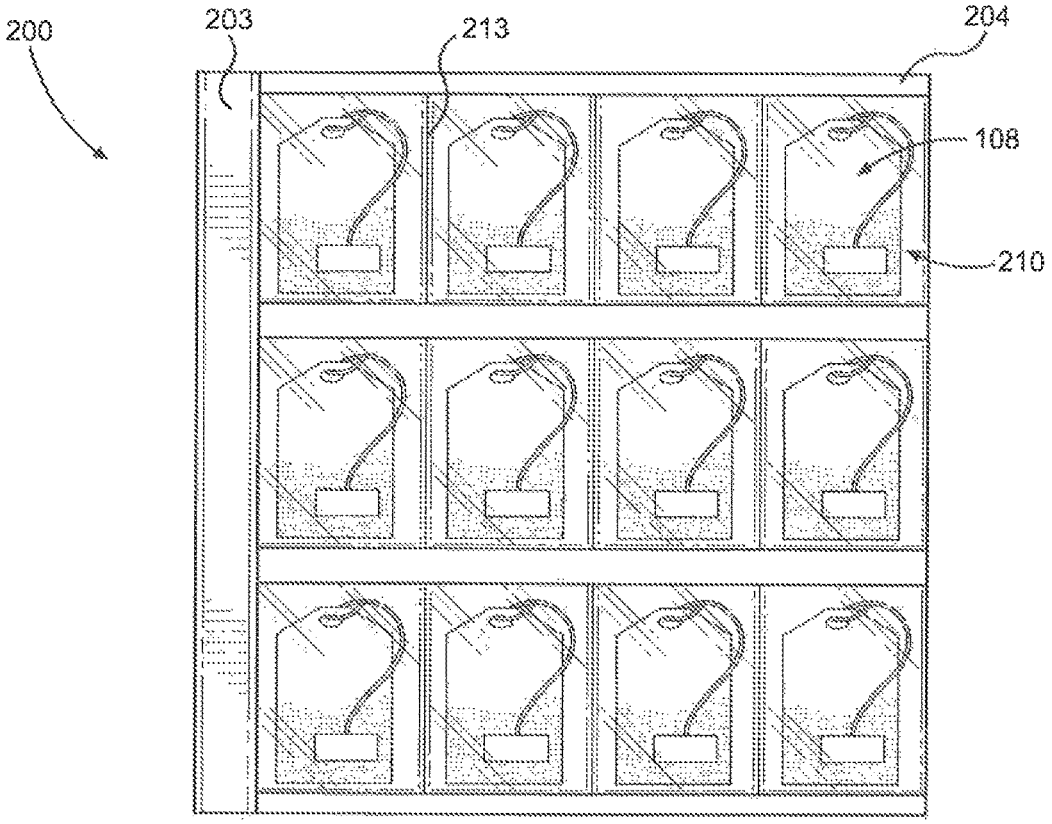
FIG. 6 is a front view of a page from an alternative embodiment of the Tea Display and Storage Device of the present invention, showing four (4) rows of three (3) tea bag holders with tea bags inside.

FIG. 6 is a front view of an individual page 204 of an alternative embodiment of the Tea Display and Storage Device 200 of the present invention. The binding 203 is shown on the left side of the page where the pages 204 are attached to one another. As stated above, there can be varying amounts of tea bag holders 210 and can be made of various materials. When a user places the tea bag 108 in a tea bag holder 210, the tea bag 108 is fully enveloped by tea bag holder 210. In addition, the tea bag 108 is visible through tea bag holder 210.

Figure 7:
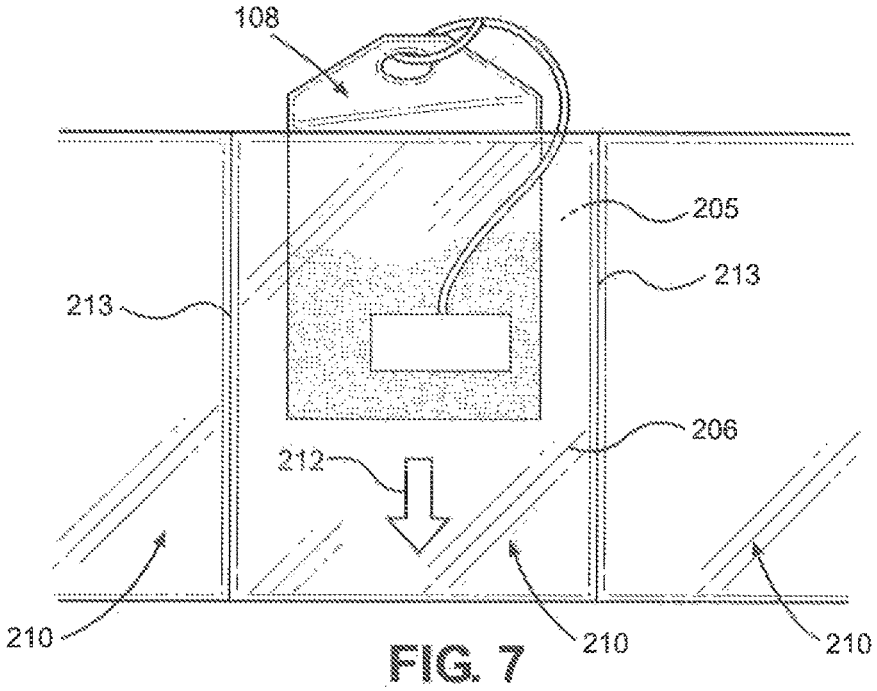
FIG. 7 is a detailed view of one (1) tea bag holder of the Tea Display and Storage Device of the present invention, showing the tea bag being inserted into the tea bag holder.

In FIG. 7, a detailed view of one (1) of the holders 210 of the alternative embodiment of the Tea Display and Storage Device 200 of the present invention is shown. To use the Tea Display and Storage Device 200 of the present invention, the user will slide the tea bag 108 into the tea bag holder 210 in the direction of directional arrow 212. As shown in FIG. 7, the tea bag holders 210 have an inside surface 205 (shown in dashed lines) and an outside surface 206. The tea bag holders 210, as shown in FIG. 7, are clear in order to show the tea bag 108 inside the tea bag holder 210. However, the tea bag holders 210 can also be opaque without deviating from the scope of the invention.

Figure 8:
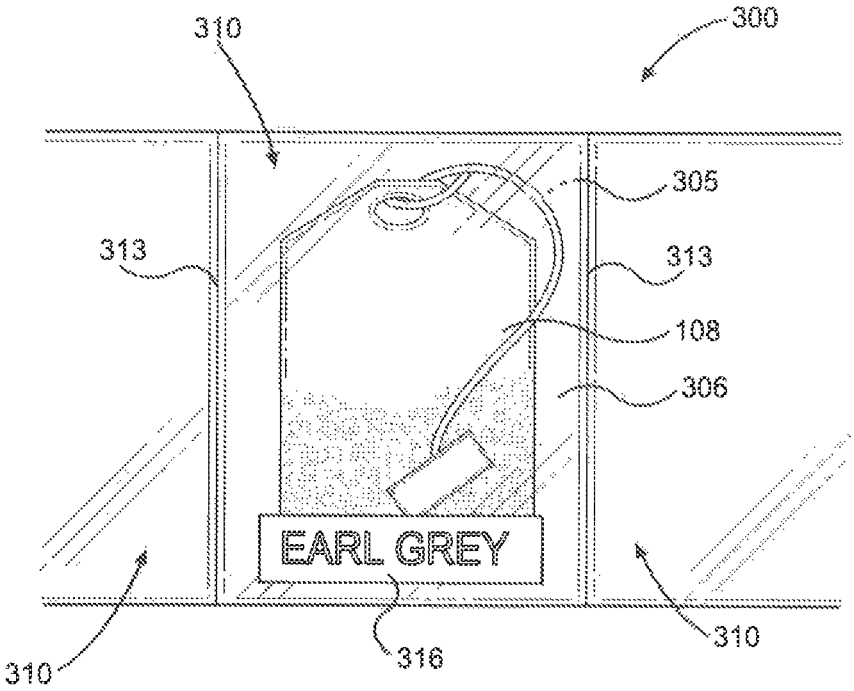
FIG. 8 is a detailed view of one (1) tea bag holder of an alternative embodiment of the Tea Display and Storage Device of the present invention, showing a tea bag inserted inside the tea bag holder with a name tag on the outside surface.

FIG. 8 is a detailed view of one (1) tea bag holder 310 of an alternative embodiment of the Tea Display and Storage Device 300 of the present invention. In this embodiment, the Tea Display and Storage Device 300 has a name tag 316 located on the outside surface 306 of tea bag holder 310. This embodiment allows consumers to readily know the type of tea bag 108 that is held by tea bag holder 310.

Figure 9:
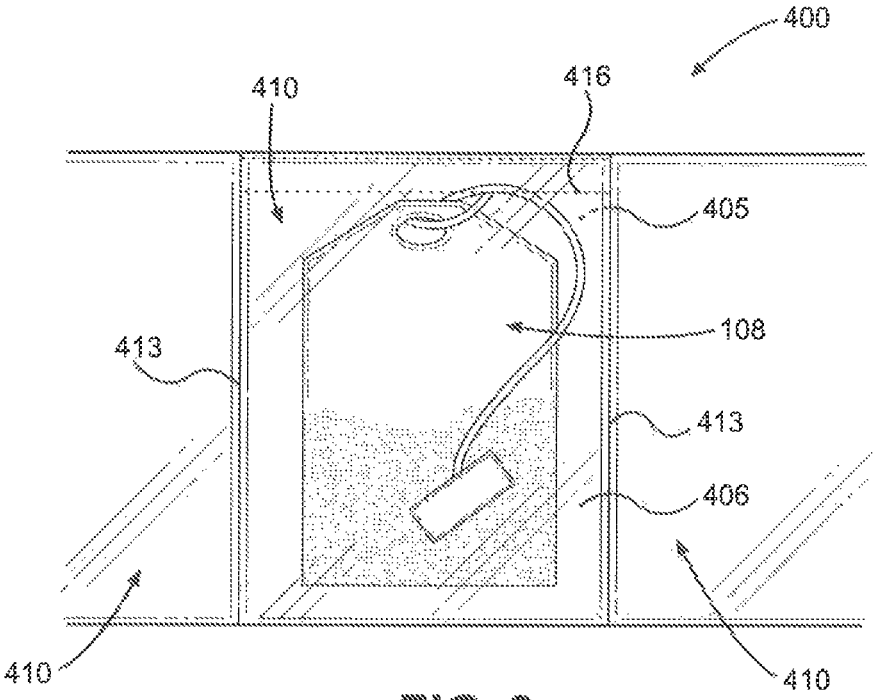
FIG. 9 is a detailed view of one (1) tea bag holder of an alternative embodiment of the Tea Display and Storage Device of the present invention, showing a tea bag inserted inside the tea bag holder with lateral tongue and groove sealing mechanism.

FIG. 9 is a detailed view of a tea bag holder 410 of an alternative embodiment of the Tea Display and Storage Device 400 of the present invention. Tea bag holder 410 is formed with a lateral tongue and groove seal 416 (shown in dashed lines) located at the top of tea bag holder 410. After the tea bag 108 is placed inside and completely enveloped by tea bag holder 410. The lateral tongue and groove seal 416 is then sealed to keep the tea bag 108 fresh. While a lateral tongue and groove seal 416 is used in FIG. 9, any sealing mechanism may be used known by those skilled in the art including, but not limited to, a zip-lock, a magnetic strip, an adhesive strip, a slide tab, etc. The tea bag holder 410 may also be formed with a tab in order to close or seal the tea bag holder 410.

Figure 10:
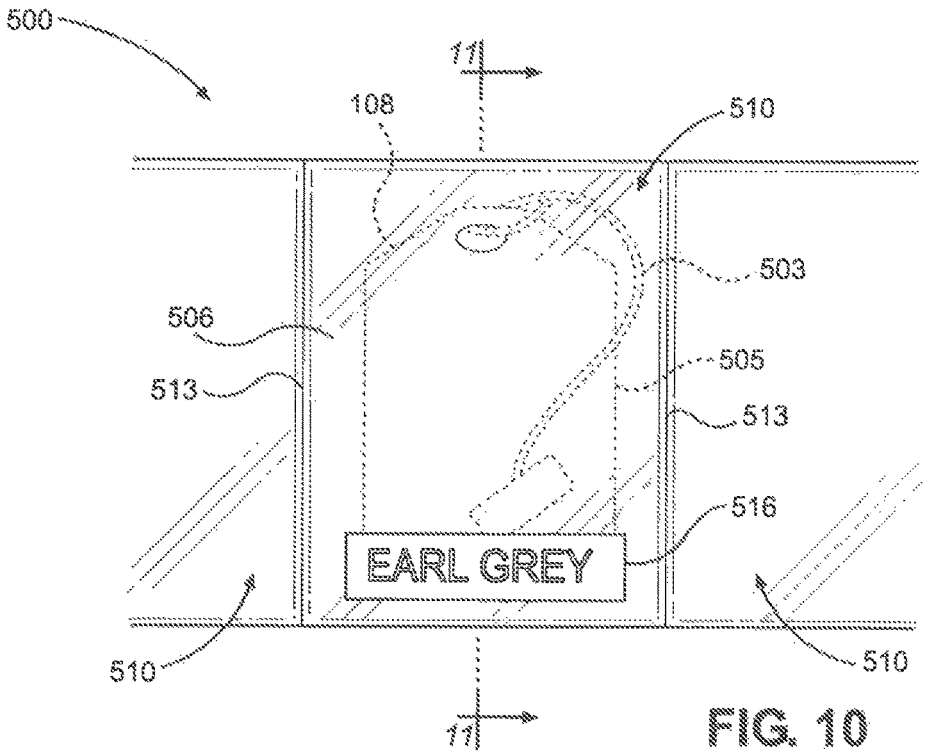
FIG. 10 is a detailed view of one (1) tea bag holder of an alternative embodiment of the Tea Display and Storage Device of the present invention, showing the tea bag holder with an absorbent layer and a name tag on the outside surface of the tea bag holder.

FIG. 10 is a detailed view of a holder 510 of an alternative embodiment of the Tea Display and Storage Device 500 of the present invention showing a tea bag holder 510 holding a tea bag 108 (shown in dashed lines) within tea bag holder 510. Tea bag holder 510 is lined with an absorbent layer 503 on the inside surface 505 of tea bag holder 510. In addition, FIG. 10 also shows a name tag 516 on the outside surface 506 of tea bag holder 510. The name tag 516 helps identify the tea bag 108 placed inside the tea bag holder.

Figure 11:
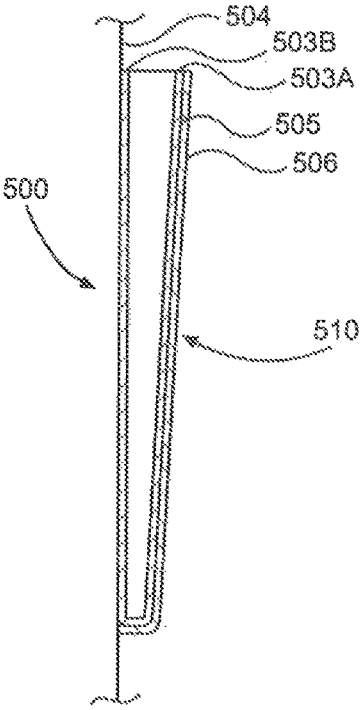
FIG. 11 is a cross sectional view of a detailed view of one (1) of the tea bag holders of the alternative embodiment of the Tea Display and Storage Device of the present invention taken from line 11-11 of FIG. 10, showing the absorbent layer and tea bag holder.

Now referring to FIG. 11, the cross-sectional view of FIG. 10 taken at line 11-11 is shown without the tea bag 108 (shown in FIG. 10). In FIG. 11 the tea bag absorbent layer 503 along the inside surface 505 of tea bag holder 510. The tea bag absorbent layer 503B lines the surface of page 504 and tea bag absorbent layer 503A lines the inside surface 505 of the tea bag holder 510. When the tea bag (not shown) is placed inside tea bag holder 510, the tea bag absorbent layer 503 absorbs any excess moisture, keeping the tea bag 108 (not shown) fresh for consumption. In addition, a means of sealing the tea bag holder 510 like the lateral tongue and groove seal 416 (shown in FIG. 9) can also be used to further ensure the freshness of the tea bag 108 (not shown).

Figure 12:
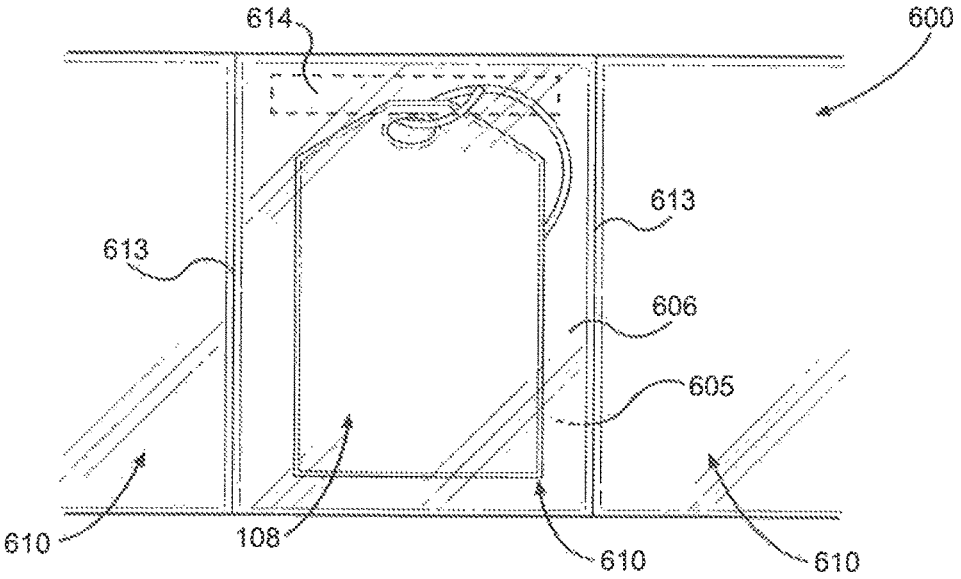
FIG. 12 is a detailed view of one (1) tea bag holder of an alternative embodiment of the Tea Display and Storage Device of the present invention, showing a tea bag holder with a magnetic strip sealing mechanism.

FIG. 12 is a detailed view of a tea bag holder 610 of an alternative embodiment of the Tea Display and Storage Device 600 of the present invention. Tea bag holder 610 is formed with a magnetic strip 614 (shown in dashed lines) located at the top of tea bag holder 610. After the tea bag 108 is placed inside and completely enveloped by tea bag holder 610. The magnetic strip 614 is then sealed to keep the tea bag 108 fresh. As stated above, any sealing mechanism may be used known by those skilled in the art including, but not limited to, a zip-lock, an adhesive strip, a slide tab, etc may be used in order to seal the tea bag holder 610. The tea bag holder 610 may also be formed with a tab in order to close or seal the tea bag holder 610.

Figure 13:
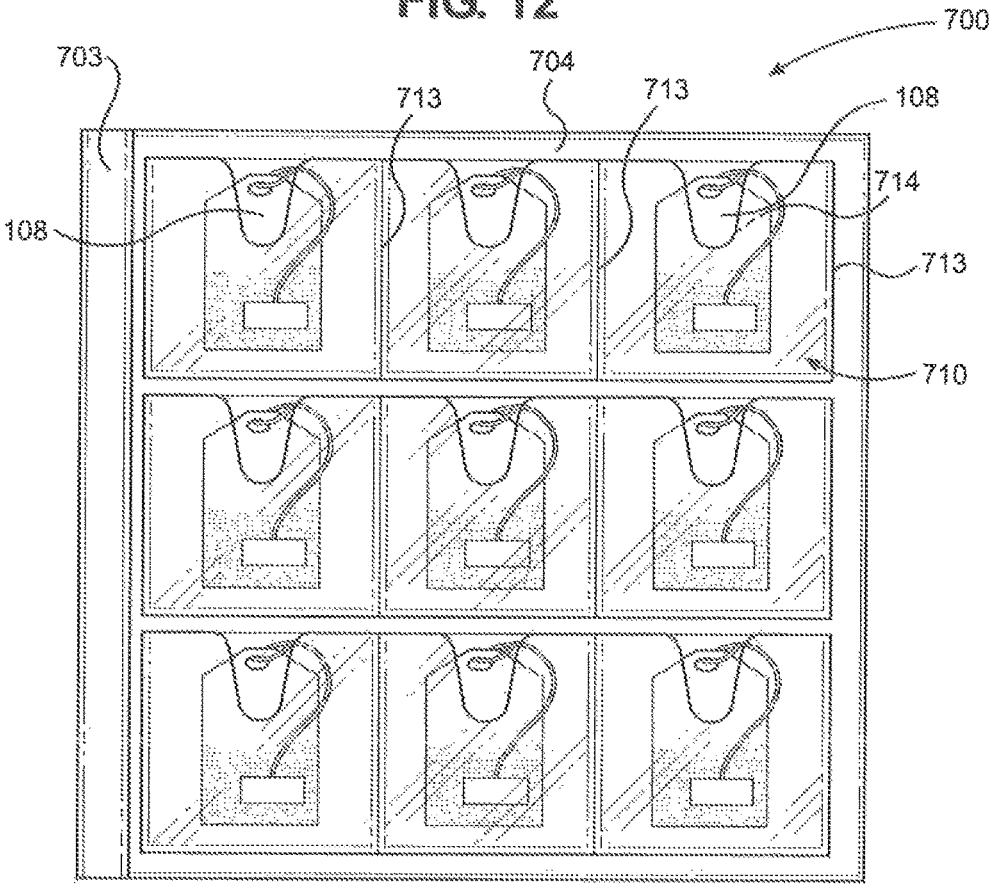
FIG. 13 is a front view of a page from an alternative embodiment of the Tea Display and Storage Device of the present invention, showing three (3) rows of three (3) tea bag holders formed with a cut out with tea bags inside.
Figure 14:
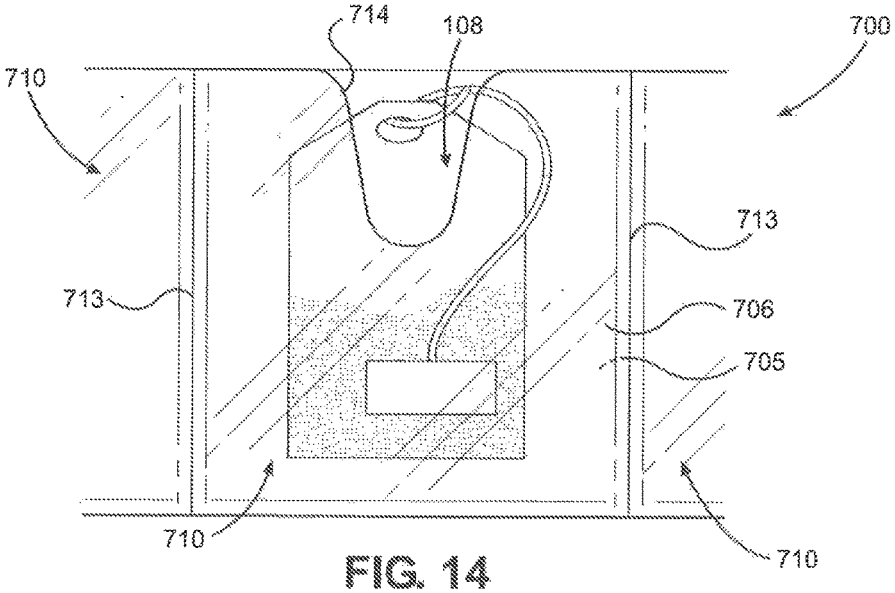
FIG. 14 is a detailed view of one (1) tea bag holder of the alternative embodiment of the Tea Display and Storage Device of the present invention, showing a tea bag inserted inside the tea bag holder formed with a cut out.

In FIGS. 13 and 14, an alternative embodiment of the Tea Display and Storage Device of the present invention is shown and generally labeled 700. Looking first at FIG. 13, a front view of an individual page 704 of the alternative embodiment of the Tea Display and Storage Device 700 of the present invention is shown. The binding 703 is shown on the left side of the page where the pages 704 are attached to one another. Pages 704 can be made of various materials including, but not limited to, plastic, cardboard, paper, etc. and can have many different colors and designs. Pages 704 have individual tea bag holders 710. The tea bag holders 710 are formed by sheets of material with seams 713 creating pockets. As with previous embodiments, page 704 may have various amounts of tea bag holders 710. Each tea bag holder 710 may vary in size and shape.

FIG. 14 shows a detailed view of one (1) tea bag holder 710. Seams 713 are shown, and tea bag holder 710 has an inside surface 705 (shown in dashed lines) and an outside surface 706. Tea bag holder 710 is also formed with a cut out 714, which allows a user to remove the tea bag 108 from the tea bag holder 710 with a single finger.

As stated above, there can be varying amounts of tea bag holders 710 and can be made of various materials. When a user places the tea bag 108 in a tea bag holder 710, the sides of tea bag 108 are fully enveloped by tea bag holder 710. In addition, the tea bag 108 is visible through tea bag holder 710. However, tea bag holder 710 can be made of a material that is opaque as described in previous embodiments. The cut out 714 formed in the tea bag holder 710 is curved in shape. The user places a finger (not shown) in the cut out 714 and onto the tea bag 108. The user then slides the tea bag 108 out of the tea bag holder 710 for use.

Figure 15:
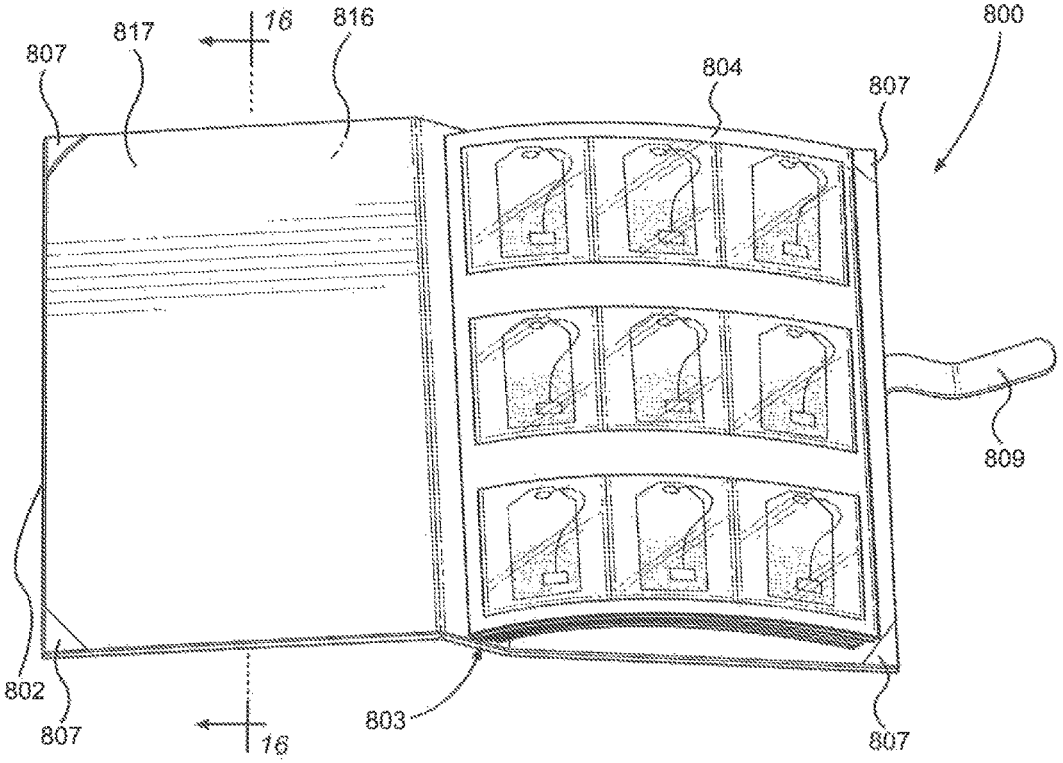
FIG. 15 is a perspective view of an alternative embodiment of the Tea Display and Storage Device of the present invention in an open configuration, showing an absorbent layer on the inside surface of the cover, embossed edges, pages, tea bag holders with tea bags.

In FIG. 15, an alternative embodiment of the Tea Display and Storage Device of the present invention is shown and generally designated 800. FIG. 15 shows the alternative embodiment of the Tea Display and Storage Device of the present invention 800 in an open configuration. The cover 802 is lined with a cover absorbent layer 817 (shown as a shaded area) on the inside surface 816 of the cover 802. The cover absorbent layer 817 is used to keep the tea bags 108 fresh from moisture.

Figure 16:
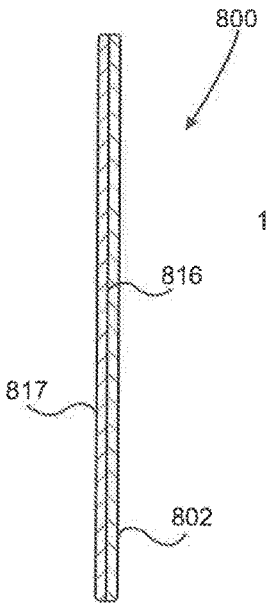
FIG. 16 is a cross sectional view of the cover of the alternative embodiment of the Tea Display and Storage Device of the present invention taken from line 16-16 of FIG. 15, showing the cover with the absorbent lining.

FIG. 16 is a cross sectional view of FIG. 15 taken along line 16-16. The cover absorbent layer 817 is shaded and located on the inside surface 816 of cover 802.

Figure 17:
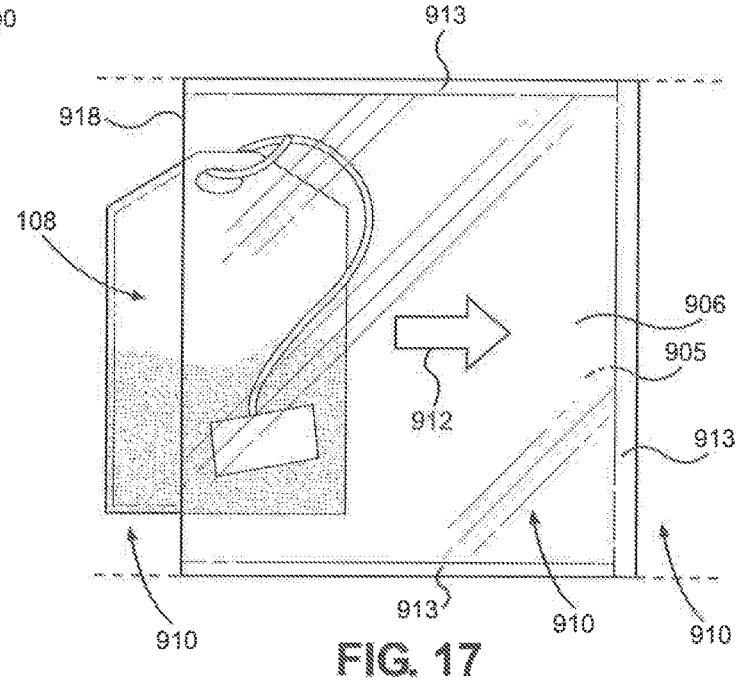
FIG. 17 is a detailed view of one (1) tea bag holder of the Tea Display and Storage Device of the present invention, showing a vertical tea bag being inserted into the tea bag holder from the left side.

In FIG. 17, an alternative embodiment of the tea bag holder 910 with the opening for the tea bag 108 on the left side. By positioning the seams 913 on the top, bottom and end opposite the lateral opening 918, the tea bag 108 can be inserted into the tea bag holder 910 laterally, in the direction of arrow 912. Seams 913 are positioned to allow teabag 108 to remain vertical.

Figure 18:
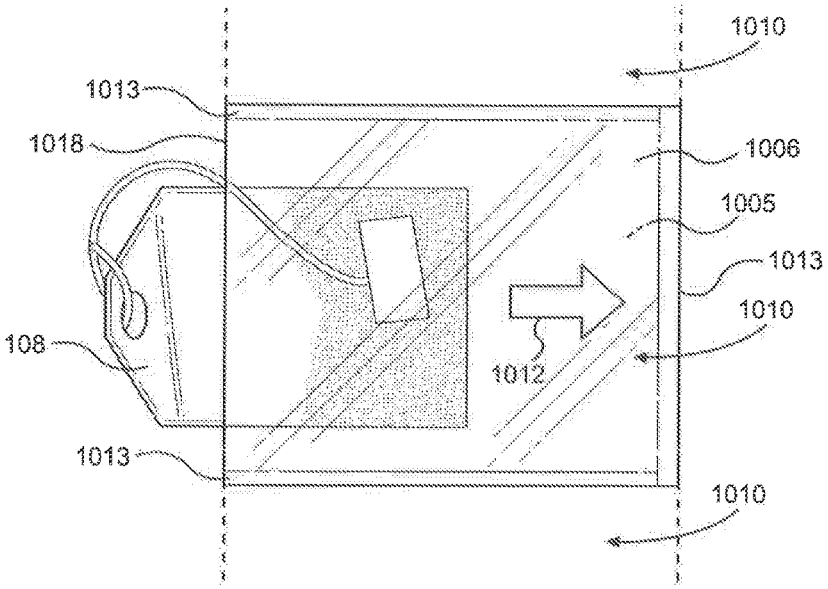
FIG. 18 is a detailed view of one (1) tea bag holder of the Tea Display and Storage Device of the present invention, showing a horizontal tea bag being inserted into the tea bag holder from the left side.

In FIG. 18, an alternative embodiment of the tea bag holder 1010 with the opening for the tea bag 108 on the left side. By positioning the seams 1013 on the top, bottom and end opposite the lateral opening 1018, the tea bag 108 can be inserted into the tea bag holder 1010 laterally, in the direction of arrow 1012. Seams 1013 are positioned to allow teabag 108 to be rotated horizontally.

Figure 19:
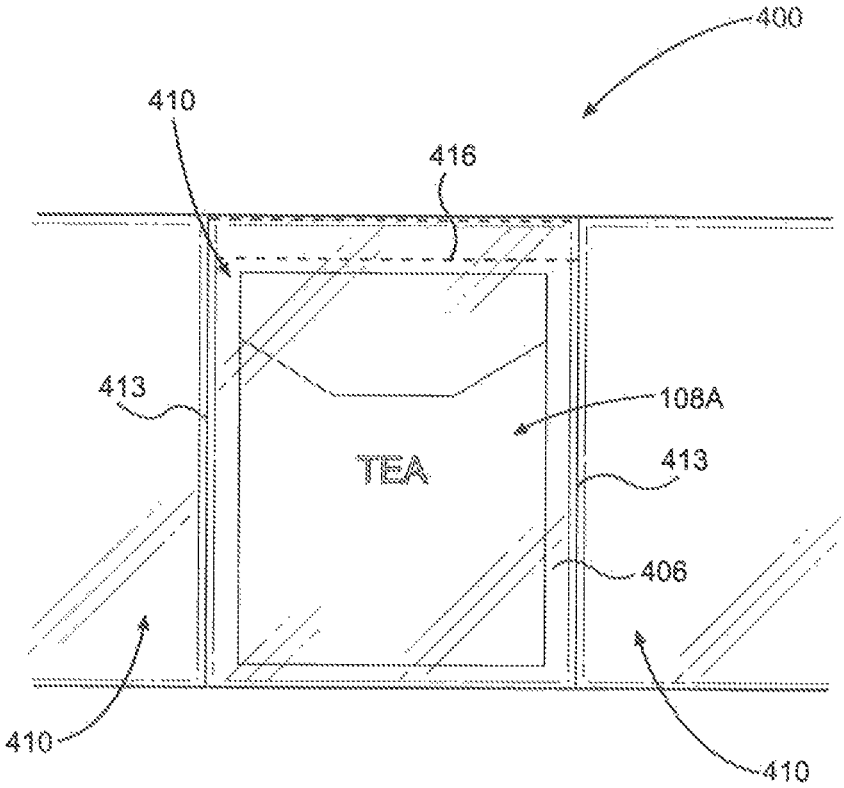
FIG. 19 is a detailed view of one (1) tea bag holder of an alternative embodiment of the Tea Display and Storage Device of the present invention, showing a tea foil package including a tea bag as inserted inside the tea bag holder with lateral tongue and groove sealing mechanism.

FIG. 19 is a detailed view of a tea bag holder 410 of an alternative embodiment of the Tea Display and Storage Device 400 shown in FIG. 9, having a groove seal 416 (shown in dashed lines) located at the top of tea bag holder 410. In this application, a tea foil package containing a tea bag is shown to depict the ability of the Tea Display and Storage Device of the present invention to be used both for loose tea bags as well as the commonly used tea packages, or tea foils.

Any of the previous mentioned embodiments can have a cover absorbent layer 817 on the inside surface 816 of cover 802 (shown in dashed lines in FIG. 15).

While there have been shown what are presently considered to be preferred embodiments of the present invention, it will be apparent to those skilled in the art that various changes and modifications can be made herein without departing from the scope and spirit of the invention.

I claim:

1. A tea display and storage device comprising
one or more tea bags
a cover with a fastener attached;
a plurality of pages attached by a binding to said cover; and
a plurality of tea bag holders comprising pockets formed by material coupled to the pages by seams, wherein a pocket is sized to accommodate a tea bag of the one or more tea bags such that a first portion of the tea bag is fully seated in the pocket and a second portion of the tea bag is uncovered by the pocket.

2. The tea display and storage device of claim 1, wherein said cover further comprises a plurality of rounded embossed edges on the corners of said cover.

3. The tea display and storage device of claim 1, wherein said cover further comprises a cover absorbent layer on said cover to absorb moisture that could come into contact with said plurality of tea bag holders.

4. The tea display and storage device of claim 1, wherein said plurality of tea bag holders further comprises a plurality of name tags coupled to outside surfaces of the tea bag holders.

5. The tea display and storage device of claim 1, wherein said plurality of tea bag holders further comprises a tea bag absorbent layer on one or more inner surfaces of the pockets.

6. The tea display and storage device of claim 1, wherein said plurality of tea bag holders further comprises curved cuts in the pockets to allow removal of said tea bags with one finger.

7. The tea display and storage device of claim 1, wherein said plurality of tea bag holders further comprises a lateral opening.

8. A tea display and storage device comprising:
one or more tea bags
a cover comprising:
a fastener attached; and
a plurality of rounded embossed edges on the corners of said cover;
a plurality of pages attached by a binding to said cover; and
a plurality of tea bag holders comprising pockets formed by material coupled to the pages by seams, wherein a pocket is sized to accommodate a tea bag of the one or more tea bags such that a first portion of the tea bag is fully seated in the pocket and a second portion of the tea bag is uncovered by the pocket.

9. The tea display and storage device of claim 8, wherein said plurality of tea bag holders further comprises a plurality of name tags coupled to outside surfaces of the tea bag holders.

10. The tea display and storage device of claim 8, wherein said plurality of tea bag holders further comprises a tea bag absorbent layer on one or more inner surfaces of the pockets.

11. The tea display and storage device of claim 8, wherein said plurality of tea bag holders further comprises curved cuts in the pockets to allow removal of tea bags with one finger.

12. The tea display and storage device of claim 8, wherein said plurality of tea bag holders further comprises a lateral opening.

13. A tea display and storage device comprising:
one or more tea bags
a cover comprising:
a fastener attached; and
a plurality of rounded embossed edges on the corners of said cover;
a plurality of pages attached by a binding to said cover; and
a plurality of tea bag holders comprising;
pockets formed by material coupled to the pages by seams, wherein a pocket is sized to accommodate a tea bag of the one or more tea bags such that a first portion of the tea bag is fully seated in the pocket and a second portion of the tea bag is uncovered by the pocket; and
a plurality of name tags coupled to outside surfaces of the tea bag holders.

14. The tea display and storage device of claim 13, wherein said plurality of tea bag holders further comprises a lateral opening.

* * * * *